US009109563B2

(12) United States Patent
Roseborsky et al.

(10) Patent No.: US 9,109,563 B2
(45) Date of Patent: Aug. 18, 2015

(54) CRADLED FUEL INJECTOR MOUNT ASSEMBLY

(75) Inventors: Steven R. Roseborsky, Kingsville (CA); Dhyana Ramamurthy, Novi, MI (US); Arunchunaikani Thalaimuthu, Sterling Heights, MI (US)

(73) Assignees: DENSO International America, Inc., Southfield, MI (US); DENSO CORPORATION, Kariya-shi, Aichi-ken ( * ) Notice: Subject to any disclaimer, the term of this patent is extended or adjusted under 35 U.S.C. 154(b) by 701 days.

(21) Appl. No.: 13/355,846

(22) Filed: Jan. 23, 2012

(65) Prior Publication Data

US 2012/0247426 A1 Oct. 4, 2012

Related U.S. Application Data

(60) Provisional application No. 61/470,342, filed on Mar. 31, 2011.

(51) Int. Cl.
*F02M 61/14* (2006.01)

(52) U.S. Cl.
CPC ..... *F02M 61/14* (2013.01); *F02M 2200/09* (2013.01); *F02M 2200/851* (2013.01); *F02M 2200/852* (2013.01); *F02M 2200/853* (2013.01); *F02M 2200/856* (2013.01)

(58) Field of Classification Search
CPC ..... F02M 21/0281; F02M 61/14; F02M 2200/851–2200/858; F02M 2200/85
USPC ..... 123/568, 456, 458, 469, 470; 239/533.2, 600; 285/305, 321; 222/181.2, 180, 173
See application file for complete search history.

(56) References Cited

U.S. PATENT DOCUMENTS

| | | | | | |
|---|---|---|---|---|---|
| 4,294,215 | A | * | 10/1981 | Hans et al. | 123/470 |
| 4,492,201 | A | * | 1/1985 | Radaelli | 123/470 |
| 4,519,371 | A | * | 5/1985 | Nagase et al. | 123/470 |
| 4,982,983 | A | * | 1/1991 | Lenzi et al. | 285/281 |
| 5,035,224 | A | * | 7/1991 | Hornby et al. | 123/470 |
| 5,136,999 | A | * | 8/1992 | Bassler et al. | 123/470 |

(Continued)

FOREIGN PATENT DOCUMENTS

EP 1892408 B1 * 10/2009

OTHER PUBLICATIONS

Office Action issued Mar. 20, 2014 in corresponding CN Application No. 2012 10088 984.4 (with English translation).

(Continued)

*Primary Examiner* — Stephen K Cronin
*Assistant Examiner* — Brian Kirby
(74) *Attorney, Agent, or Firm* — Harness, Dickey & Pierce, P.L.C.

(57) ABSTRACT

A fuel injector cradle mount assembly for a vehicle includes a fuel injector rail, a connective inlet assembly coupled to the fuel injector rail, a cradle coupled to the connective inlet assembly, and a fuel injector. The fuel injector includes a torso and a nozzle. The torso includes a base portion on a first end, and defines an inlet on a second end opposite the first end. The fuel injector is arranged between the connective inlet assembly and the cradle. The inlet of the fuel injector is coupled to the connective assembly, the base portion of the fuel injector rests on the cradle, and the cradle supports the fuel injector from the connective inlet assembly and the fuel injector rail.

8 Claims, 16 Drawing Sheets

(56) References Cited

U.S. PATENT DOCUMENTS

| | | | | |
|---|---|---|---|---|
| 5,301,647 | A * | 4/1994 | Lorraine | 123/470 |
| 5,479,900 | A * | 1/1996 | Bodenhausen et al. | 123/470 |
| 5,785,024 | A * | 7/1998 | Takei et al. | 123/470 |
| 5,901,688 | A * | 5/1999 | Balsdon et al. | 123/516 |
| 5,909,725 | A * | 6/1999 | Balsdon et al. | 123/516 |
| 6,019,089 | A * | 2/2000 | Taylor et al. | 123/470 |
| 6,637,411 | B2 * | 10/2003 | Makiyama | 123/470 |
| 6,772,736 | B2 * | 8/2004 | Liskow | 123/470 |
| 7,237,534 | B2 * | 7/2007 | Imamura | 123/470 |
| 7,334,571 | B1 * | 2/2008 | Beardmore | 123/470 |
| 7,360,524 | B2 * | 4/2008 | Zdroik et al. | 123/470 |
| 7,556,022 | B1 * | 7/2009 | Doherty et al. | 123/470 |
| 7,861,692 | B2 * | 1/2011 | Biasci et al. | 123/470 |
| 8,087,398 | B2 * | 1/2012 | Harvey et al. | 123/470 |
| 8,286,612 | B2 * | 10/2012 | Biasci et al. | 123/470 |
| 8,646,434 | B2 * | 2/2014 | Harvey et al. | 123/470 |
| 2004/0194764 | A1 * | 10/2004 | Okajima et al. | 123/469 |
| 2005/0161025 | A1 * | 7/2005 | Braun et al. | 123/470 |
| 2007/0295309 | A1 | 12/2007 | Zdroik et al. | |
| 2008/0302336 | A1 * | 12/2008 | Fuerst et al. | 123/470 |
| 2009/0056674 | A1 * | 3/2009 | Furst et al. | 123/470 |
| 2009/0064972 | A1 * | 3/2009 | Abe et al. | 123/456 |
| 2009/0229576 | A1 * | 9/2009 | Biasci et al. | 123/470 |
| 2010/0012093 | A1 * | 1/2010 | Pepperine et al. | 123/470 |
| 2010/0071668 | A1 * | 3/2010 | Biasci et al. | 123/470 |

OTHER PUBLICATIONS

Office Action issued Feb. 12, 2015 in corresponding CN Application No. 2012 10088 984.4 (with English translation).

* cited by examiner

CRADLED FUEL INJECTOR MOUNT ASSEMBLY

CROSS-REFERENCE TO RELATED APPLICATIONS

This application claims the benefit of U.S. Provisional Application No. 61/470,342, filed on Mar. 31, 2011. The entire disclosure of the above application is incorporated herein by reference.

FIELD

The present disclosure relates to a fuel injector mount, and more specifically, to a cradled fuel injector mount.

BACKGROUND

This section provides background information related to the present disclosure which is not necessarily prior art. Current internal combustion engines for vehicles employ the use of fuel injectors to spray high pressured fuel from a fuel injector rail into a cylinder head of an engine. Individual fuel injectors typically rest on the cylinder head and transmit a high frequency vibration into the cylinder head which causes noise, vibration, and harshness (NVH) that can be heard at an unacceptable level by passengers in the passenger compartment within the vehicle. Moreover, relative levels of NVH may cause relative wear on individual parts in contact with each other.

What is needed then is a device to reduce NVH originating from operation of the fuel injectors.

SUMMARY

This section provides a general summary of the disclosure, and is not a comprehensive disclosure of its full scope or all of its features. A fuel injector cradle mount assembly for a vehicle may include a fuel injector rail, a connective inlet assembly coupled to the fuel injector rail, a cradle coupled to the connective inlet assembly, a fuel injector including a torso and a nozzle. The torso may have a first end and a second end. The torso may have a base portion on the first end and may define an inlet on the second end opposite the first end. The fuel injector may be arranged between the connective inlet assembly and the cradle. The inlet of the fuel injector may be coupled to the connective assembly, the base portion of the fuel injector may rest on the cradle, and the cradle may support the fuel injector from the connective inlet assembly and the fuel injector rail.

The cradle may include a body, a shoulder, and two panels. The body may define an opening in which the fuel injector may be received. The shoulder may extend from a bottom end of the body towards the opening. The shoulder may have an "L" shape cross-section. The panels may extend from a top end of the body on opposite sides of the body. The base may rest on the shoulder and the panels may be directly coupled to the connective inlet assembly.

The nozzle of the fuel injector may include a third end and a fourth end. The third end may be received by an engine. The fourth end, which is opposite the third end, abuts to the base of the torso. The engine may receive the nozzle first and the base second. The fuel injector may be axially supported at the base by the cradle and the fuel injector rail, and may be radially aligned by the engine.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
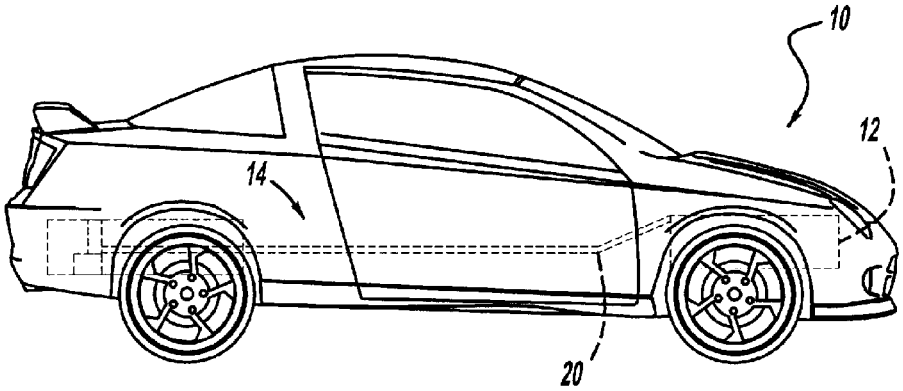
FIG. 1 is a side view of an exemplary vehicle depicting portions of a fuel system in accordance with the present disclosure.
Figure 2:
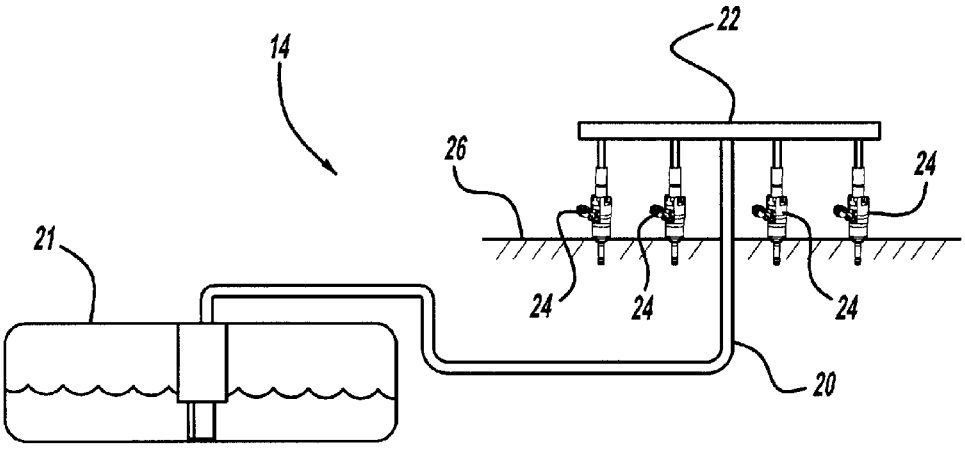
FIG. 2 is a schematic drawing depicting fuel injectors in accordance with the present disclosure.

Example embodiments will now be described more fully with reference to FIGS. 1-10 of the accompanying drawings. With initial reference to FIGS. 1 and 2, a vehicle 10, such as an automobile, may be equipped with an internal combustion engine 12 that receives fuel from a fuel supply system 14. The fuel supply system 14 may include a fuel supply line 20, a fuel injector rail 22 (also referred to as a "common rail"), and a plurality of fuel injectors 24 connected to fuel injector rail 22. Fuel supply line 20 carries fuel from a fuel tank 21 to fuel injector rail 22. During operation of engine 12, fuel passes from fuel injector rail 22 into fuel injector 24 and is subsequently sprayed into engine 12, through an intake manifold or a cylinder head 26 and into a combustion cylinder for combustion.

Figure 3:
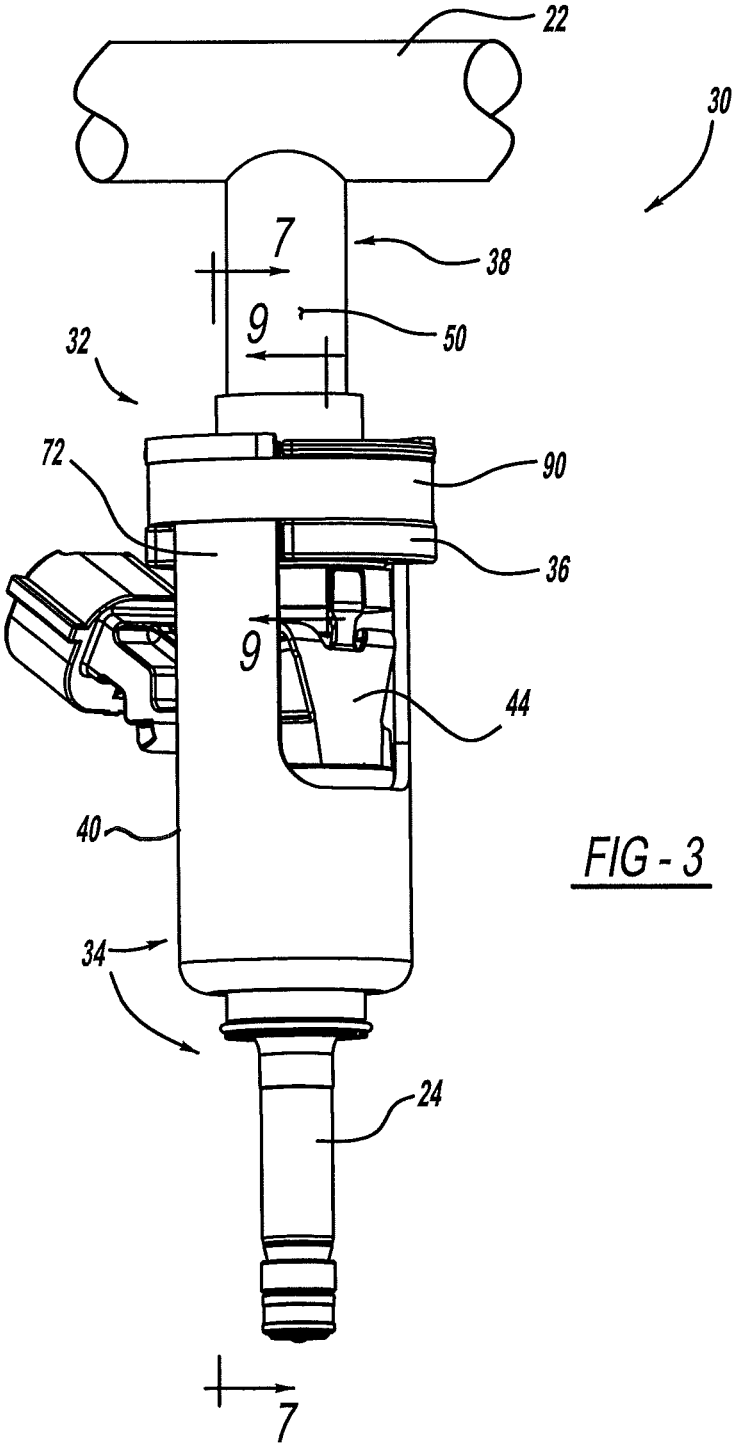
FIG. 3 is a side view depicting a fuel injector in a fuel injector cradle mount assembly in accordance with the present disclosure.
Figure 4:
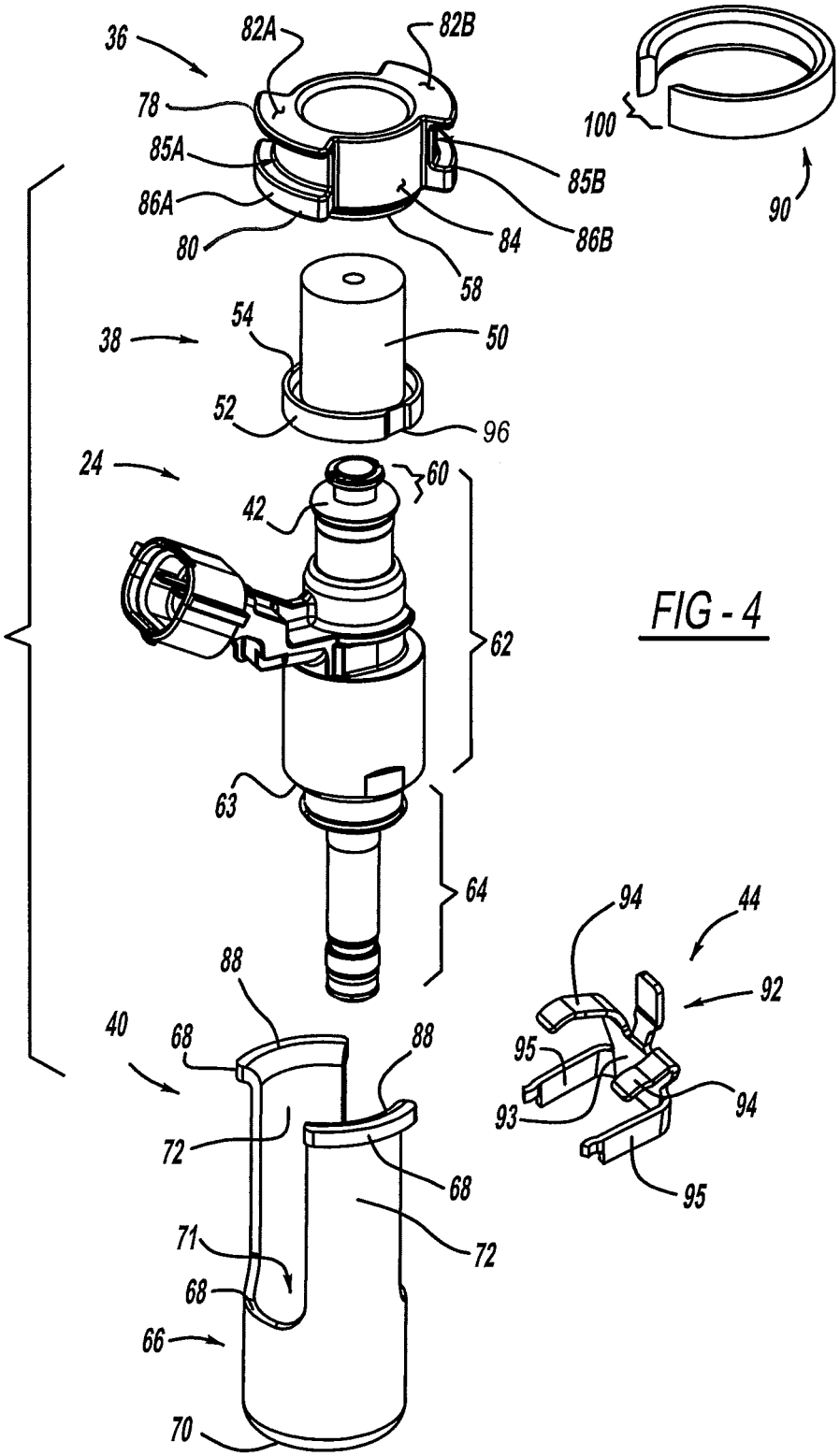
FIG. 4 is an exploded view of the fuel injector cradle mount assembly of FIG. 3.
Figure 5:
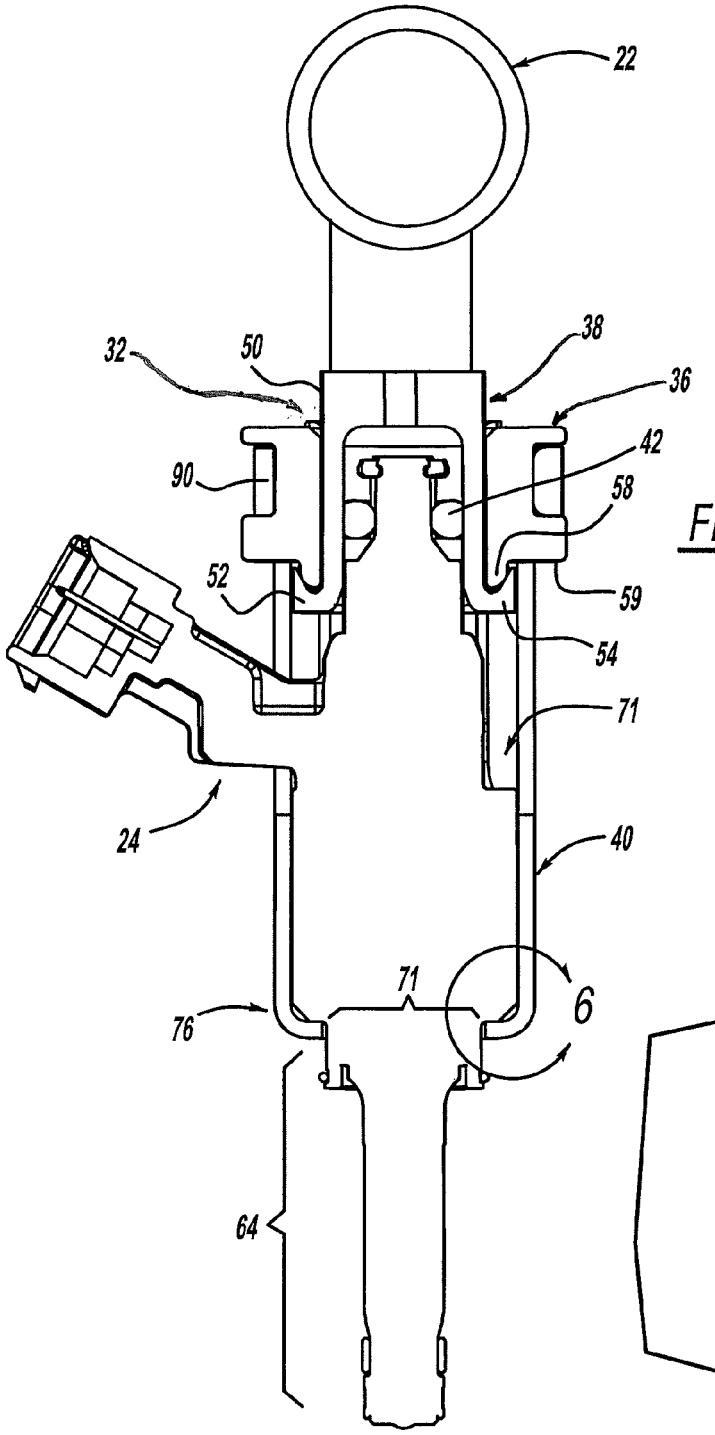
FIG. 5 is a cross-sectional view of the fuel injector cradle mount assembly of FIG. 3.

With reference now including FIGS. 3, 4 and 5, fuel injector 24 may be mounted in a fuel injector cradle mount assembly 30 in accordance with the present disclosure. Fuel injector cradle mount assembly 30 may include a connective inlet assembly 32 and an injector cradle assembly 34. Connective inlet assembly 32 may include an alignment ring 36 that may couple to or be attached to a fuel cup 38. Fuel cup 38 may include a column 50, where a first end of column 50 is coupled to fuel injector rail 22, and a second end of column 50 is formed to create a collar 52 that defines a cavity 54. It should be noted that the overall configuration of fuel cup 38 may vary depending on the design of a vehicle and the placement of fuel injector 24.

Alignment ring 36 includes a rim 58, which may be located on (e.g. protruding from) a bottom portion 59 (FIG. 5), an upper perimeter 78 and a bottom perimeter 80, which may be located below upper perimeter 78 (FIG. 4). Upper perimeter 78 may include a first ledge 82A and a second ledge 82B, which may be referred to as upper ledges 82A, 82B. Upper ledges 82A, 82B may be located at or on opposite sides of upper perimeter 78. A flush surface 84 may be located between ledges 82A, 82B. A bottom perimeter 80 may include a first bottom ledge 86A and a second bottom ledge 86B, which may be referred to as bottom ledges 86A, 86B. Bottom ledges 86A, 86B may be aligned below upper ledges 82A, 82B such that when a line is drawn between a terminal end of upper ledge 82A and a terminal end of bottom ledge 86A, such line is parallel to a central vertical axis of alignment ring 36. Bottom ledges 86A, 86B may extend or protrude from opposite sides of bottom perimeter 80 with flush surface 84 located therebetween. Upper ledges 82A, 82B and bottom ledges 86A, 86B cooperate to form a pair of retention grooves 85A, 85B therebetween. Although the terms first, second are to describe ledges and grooves, it should be understood that there may be more than two or less than two ledges or grooves. Alignment ring 36 may be used to secure or couple connective inlet assembly 32 to injector cradle assembly 34. Alignment ring 36 may be made of stainless steel.

Alignment ring 36 may slide onto column 50 of fuel cup 38 such that bottom portion 59 is arranged to face collar 52. Rim 58 rests in cavity 54 and may couple alignment ring 36 to fuel cup 38 (FIG. 5). Fuel cup 38 may be coupled to fuel injector rail 22 (e.g. by brazing, welding, or other process). Connective inlet assembly 32 provides an inlet for fuel traveling from fuel injector rail 22 to fuel injector 24 and into engine 12. It also provides support for injector cradle assembly 34, as described in further detail below.

Injector cradle assembly 34 may include a cradle 40 in which fuel injector 24 may be received (FIG. 3). Fuel injector 24 may include a torso section 62 and a nozzle section 64 (FIG. 4). Torso 62 may define an inlet 60 on a first end and a base 63 on a second end, which is opposite the first end. It should be understood that the location of inlet 60, torso 62, base 63 and nozzle 64 may be dependent upon fuel injector 24, and as such may vary in position. In some embodiments, base 63 may be part of torso 62 that is closest to nozzle 64.

Cradle 40 may include a body 66 (FIG. 4), which may include a top edge 68 and a bottom edge 70, and may define an opening 71 to receive fuel injector 24. At least two panels 72 may extend from top edge 68 on opposite sides of body 66. Top edge 68 of panels 72 may outwardly protrude away from opening 71 and form a crown 88, which may be perpendicular to a central vertical axis of cradle 40. Cradle 40 may be elongated and cylindrical and may have less than two or more than two panels 72.

Figure 6:
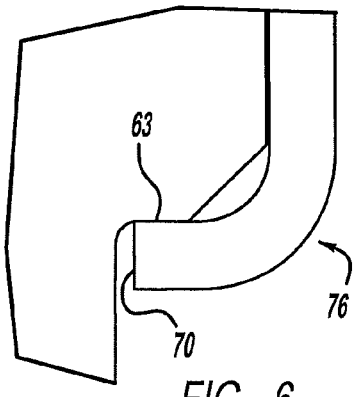
FIG. 6 is an enhanced view of the fuel injector in contact with a cradle of the fuel injector cradle mount assembly of FIG. 3.

Cradle 40 may further include a reinforcement shoulder 76 (FIGS. 5 and 6). Reinforcement shoulder 76 may be formed by bending bottom edge 70 in an inwardly direction, which may be toward the central vertical axis of cradle 40. Opening 71 may be formed by bottom edge 70 and may be formed by a complete perimeter of bottom edge 70. Thus, in cross-section, shoulder 76 may be formed of "legs" that meet at a ninety degree angle or approximately a ninety degree angle. Moreover, the intersection of the legs forming shoulder 76 may be "L" shaped in cross-section. In some embodiments cradle 40 may be monolithically formed of stainless steel. It should be understood that the overall configuration of cradle 40 may vary depending on the design of the fuel injector and position of connective inlet assembly 32.

Figure 7:
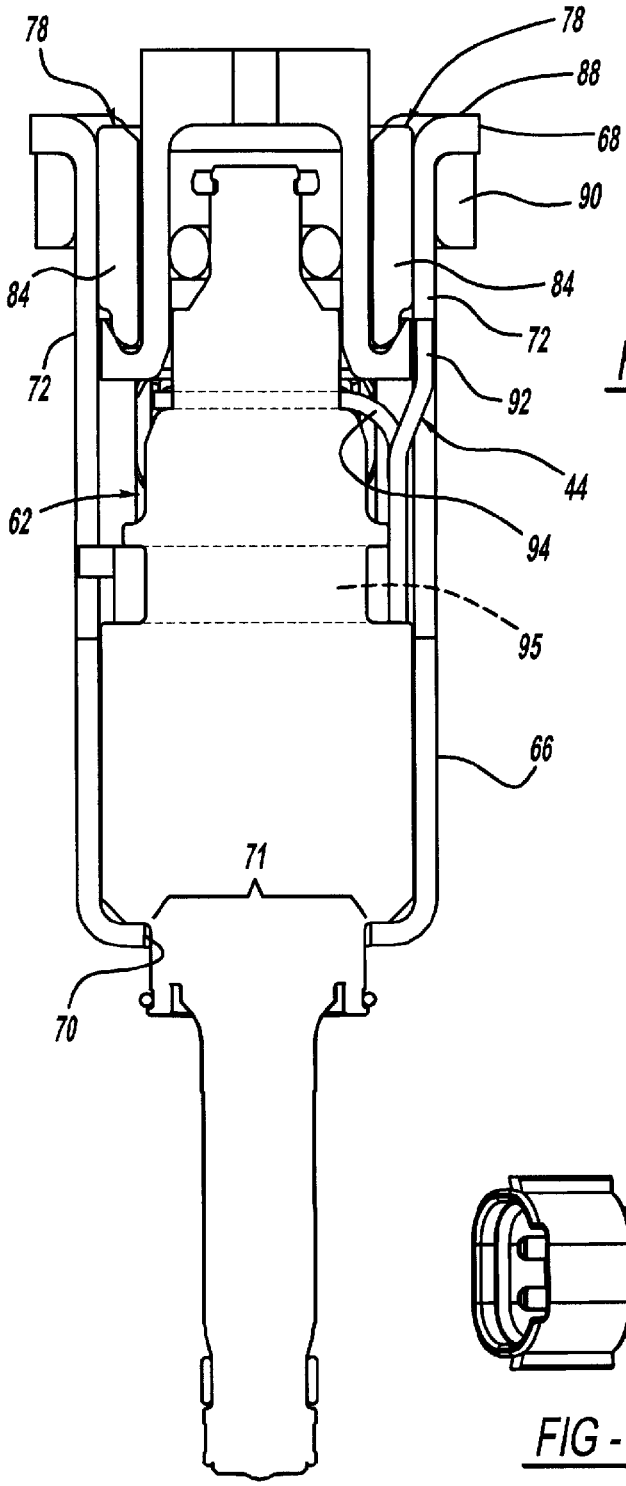
FIG. 7 is a sectional view of the fuel injector cradle mount assembly of FIG. 3 taken along line 7-7.
Figure 8:
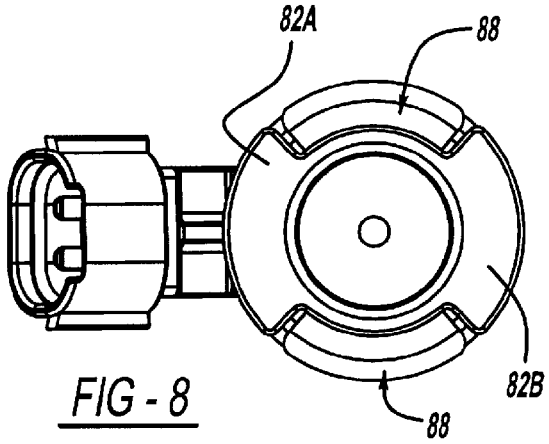
FIG. 8 is a top view of the fuel injector cradle mount assembly of FIG. 3.

In the assembled condition of fuel injector cradle mount assembly 30, cradle 40 may receive fuel injector 24 through opening 71. Nozzle 64 may pass beyond reinforcement shoulder 76 through opening 71, and base 63 may rest on reinforcement shoulder 76 (FIG. 5 and FIG. 6). Inlet 60 of fuel injector 24 may be coupled to connective inlet assembly 32. Panels 72 may be aligned along side of flush surface 84 up to upper perimeter 78 (FIG. 7). Crown 88 may be positioned next to upper ledge 82A, 82B on either side of upper perimeter 78 (FIG. 8).

Figure 9:
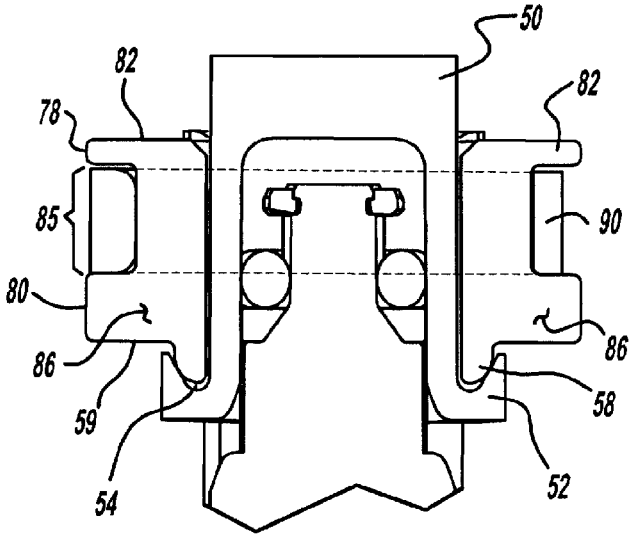
FIG. 9 is a partial cross-sectional view of the fuel injector cradle mount assembly of FIG. 3 taken along line 9-9.

Connective inlet assembly 32 and injector cradle assembly 34 then may be secured with a retention ring 90 defining a mouth 100 (FIG. 4). Using a tool, which is not depicted, retention ring 90 may be extended at mouth 100, and positioned into retention groove 85A, 85B (FIG. 9). Retention ring 90 may be positioned under upper ledge 82A, 82B and crown 88 and above bottom ledge 86A, 86B (FIGS. 7 and 9). Upper ledge 82A, 82B, crown 88 and bottom ledge 86A, 86B may secure vertical alignment of retention ring 90. Retention ring 90 may exert a clasping force onto retention groove 85A, 85B and panel 72 to securely couple connective inlet assembly 32 to injector cradle assembly 34 (FIG. 3). It should be understood that connective inlet assembly 32 and injector cradle assembly 34 may be coupled by other means, examples of which are discussed further below in the various embodiments.

Figure 10:
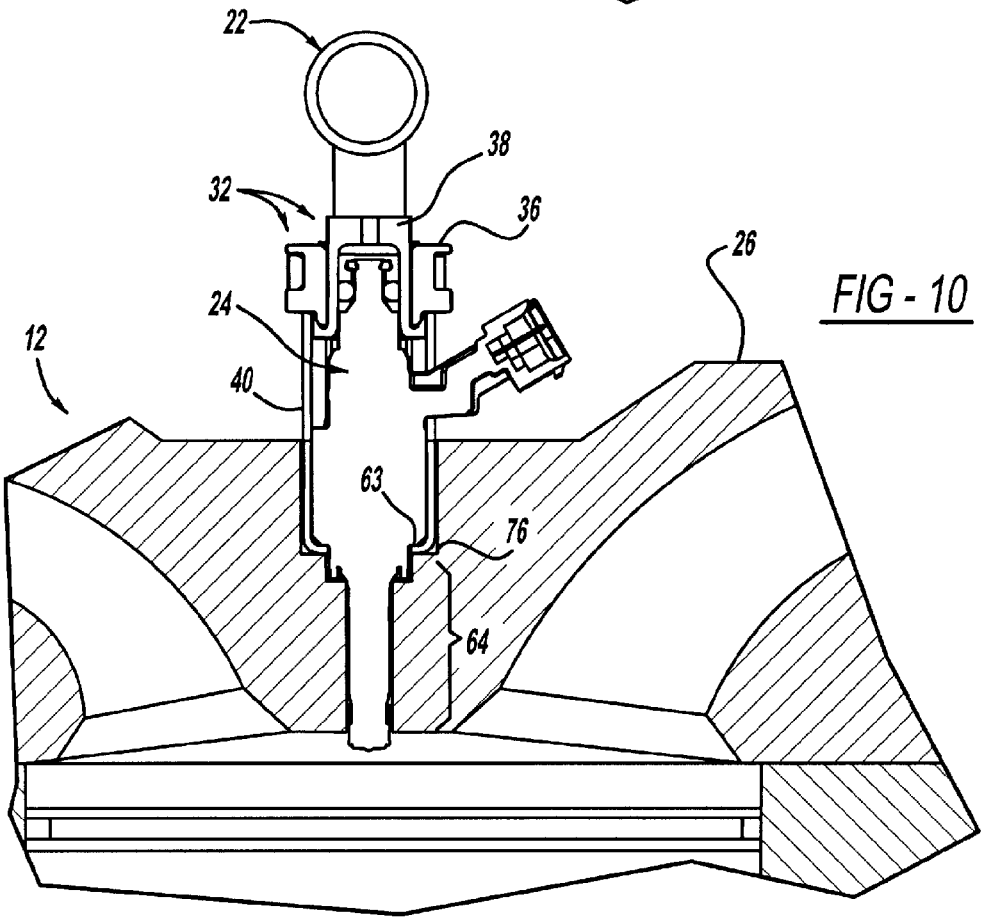
FIG. 10 is a partial cross-sectional view of a fuel injector cradle mount assembly, a fuel injector rail, and a cylinder head in accordance with the present disclosure.

In assembled condition, nozzle 64 may be received by engine 12 followed by base 63 (FIG. 10). By supporting fuel injector 24 from base 63 and coupling panels 72 to connective inlet assembly 32, fuel injector 24 may be axially supported at base 63 by cradle 40 and fuel injector rail 22, and may be radially aligned by engine 12 (FIGS. 3 and 10). Thus, vibrations from fuel injector 24 may be transferred into reinforcement shoulder 76 of cradle 40, then up to and into alignment ring 36, fuel cup 38, and finally into fuel injector rail 22 thereby reducing vibration transmission from cylinder head 26 and an engine block of engine 12 into fuel injector 24 and associated parts that retain fuel injector 24. In such a way vibration transmission to a vehicle occupant may be reduced, thus reducing overall NVH experienced or felt by passengers in a vehicle.

In an assembled condition, fuel injector 24 may be received and secured within fuel cup 38 with the aid of a compressed O-ring 42, which sits over inlet 60 of fuel injector 24 (FIGS. 4 and 5). By allowing fuel injector 24 to rest on cradle 40, fuel injector 24 may be securely suspended between fuel injector rail 22 and cradle 40 such that any misalignments of inlet 60 are reduced. Furthermore, by suspending cradle 40 by alignment ring 36, alignment ring 36 may be able to more evenly redistribute and transmit any vibrations or side loads originating from fuel injector 24 such that the loads remains primarily on the center of O-ring 42.

Fuel injector cradle mount assembly 30 may also include a clip 44 (FIG. 3). Clip 44 may include a neck 92, a frame 93, two cantilever arms 94 that extend from frame 93, and two legs 95 that project from the side of frame 93 below arms 94 (FIG. 4). In assembled condition, clip 44 may be positioned onto torso 62 of fuel injector 24 (FIG. 7). Arms 94 clasp or clamp over torso 62 and legs 95 enclose around the midsection of torso 62. Arms 94 and legs 95 resist forces that push them closer to one another. When compressed, arms 94 contact and exert a force onto connective inlet assembly 32, while legs 95 contact and exert a force onto torso 62, thus resulting in a tight press fit across fuel injector cradle mount assembly 30 and reducing or eliminating unwanted movement. Upon clip 44 being positioned and installed, neck 92 rests on an indentation 96 that is defined on collar 52 of fuel cup 38 (FIGS. 4 and 7). Neck 92 restricts rotational movement of fuel injector cradle mount assembly 30.

Figure 11:
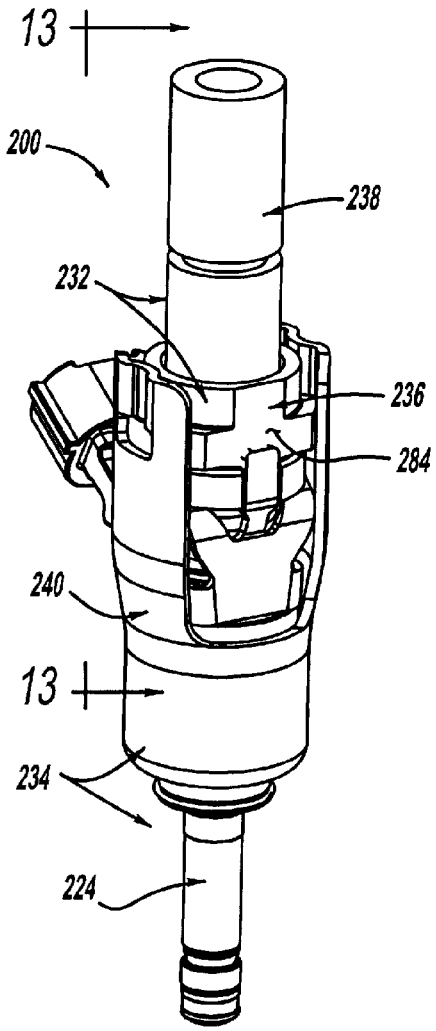
FIG. 11 is a side view depicting a fuel injector in a fuel injector cradle mount assembly in accordance with the present disclosure.
Figure 12:
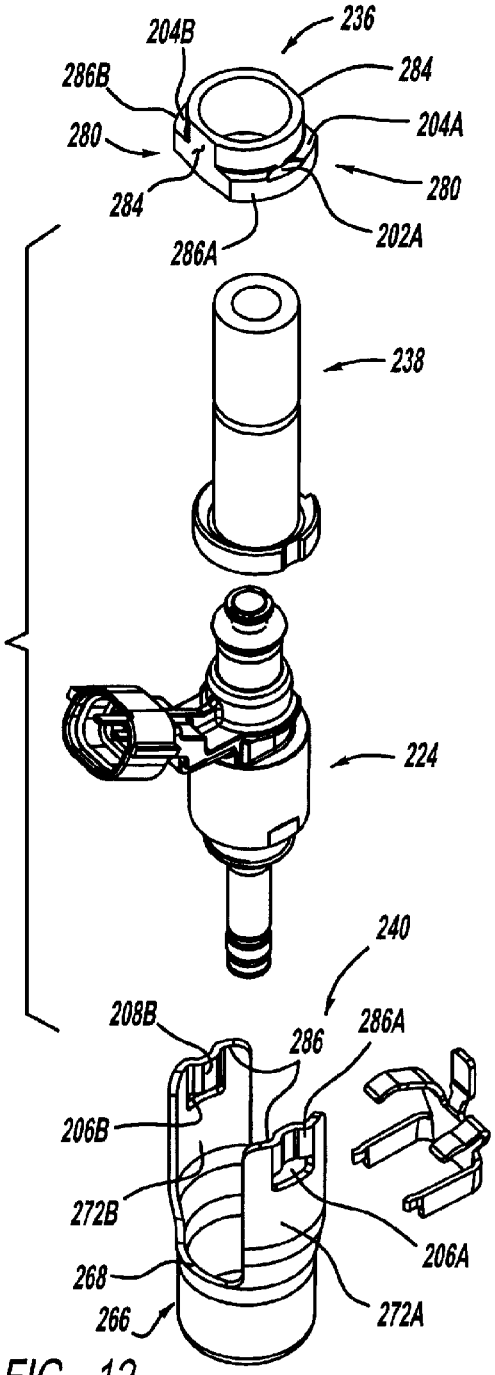
FIG. 12 is a exploded view of the fuel injector cradle mount assembly of FIG. 11.
Figure 13:
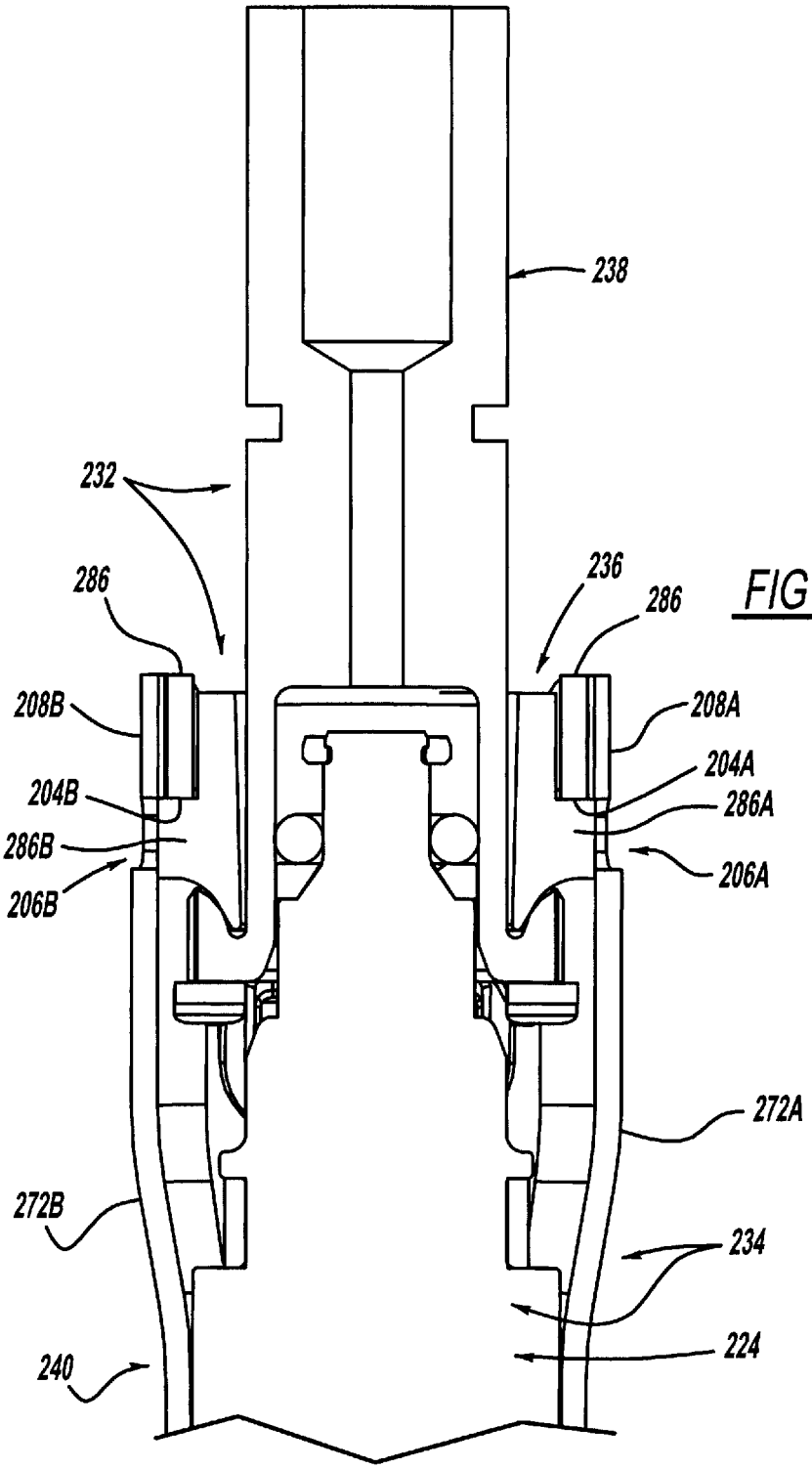
FIG. 13 is a partial cross-sectional view of the fuel injector cradle mount assembly of FIG. 11 taken along line 13-13.

With reference now to FIGS. 11, 12, and 13 a fuel injector 224 may be mounted in a fuel injector cradle mount assembly 200 in accordance with the present disclosure. Fuel injector cradle mount assembly 200, like fuel injector cradle mount assembly 30, may include a connective inlet assembly 232 and an injector cradle assembly 234. Connective inlet assembly 232 may include an alignment ring 236 and a fuel cup 238. Injector cradle assembly 234 may include a cradle 240 and fuel injector 224. Fuel injector cradle mount assembly 200 may be very similar to fuel injector cradle mount assembly 30, including that described further. Alignment ring 236 may include a bottom perimeter 280. Bottom perimeter 280 may include a first bottom ledge 286A and a second bottom ledge 286B, which may be referred to as ledge 286A, 286B. Ledge 286A, 286B may extend or protrude from opposite sides of bottom perimeter 280 with a flush surface 284 located therebetween. Ledge 286A may define a notch 202A on a top surface 204A of ledge 286A, and ledge 286B may define a notch 202B on a top surface 204B of ledge 286B (notch 202B not shown but may be similar to notch 202A). Notch 202A and notch 202B may be referred to as notch 202A, 202B, and top surface 204A and top surface 204B may be referred to as top surface 204A, 204B. Cradle 240 may include a first panel 272A and a second panel 272B, which may be referred to as panel 272A, 272B. Panel 272A, 272B may extend from a top edge 268 on opposite sides of a body 266. Panel 272A may define a hole 206A and panel 272B may define a hole 206B, which may be referred to as hole 206A, 206B. Above hole 206A, 206B, panel 272A, 272B may indent inward to form a crimp 208A, 208B, respectively. Connective inlet assembly 232 and injector cradle assembly 234 may be secured by aligning panel 272A, 272B along flush surface 284 of alignment ring 236. Alignment ring 236 may be rotated to align notch 202A, 202B under crimp 208A, 208B, respectively. Crimp 208A, 208B may exert a clasping force onto top surface 204A, 204B and notch 202A, 202B to securely couple connective inlet assembly 232 and injector cradle assembly 234.

Figure 14:
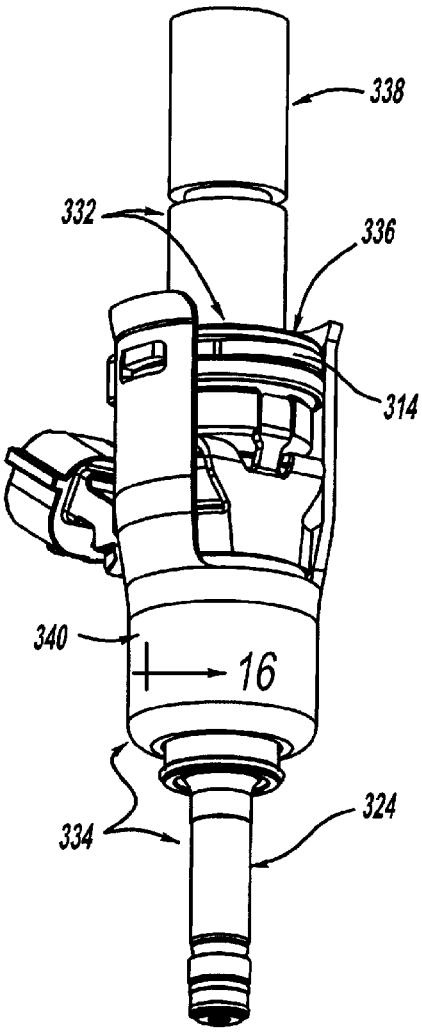
FIG. 14 is a side view depicting a fuel injector in a fuel injector cradle mount assembly in accordance with the present disclosure.
Figure 15:
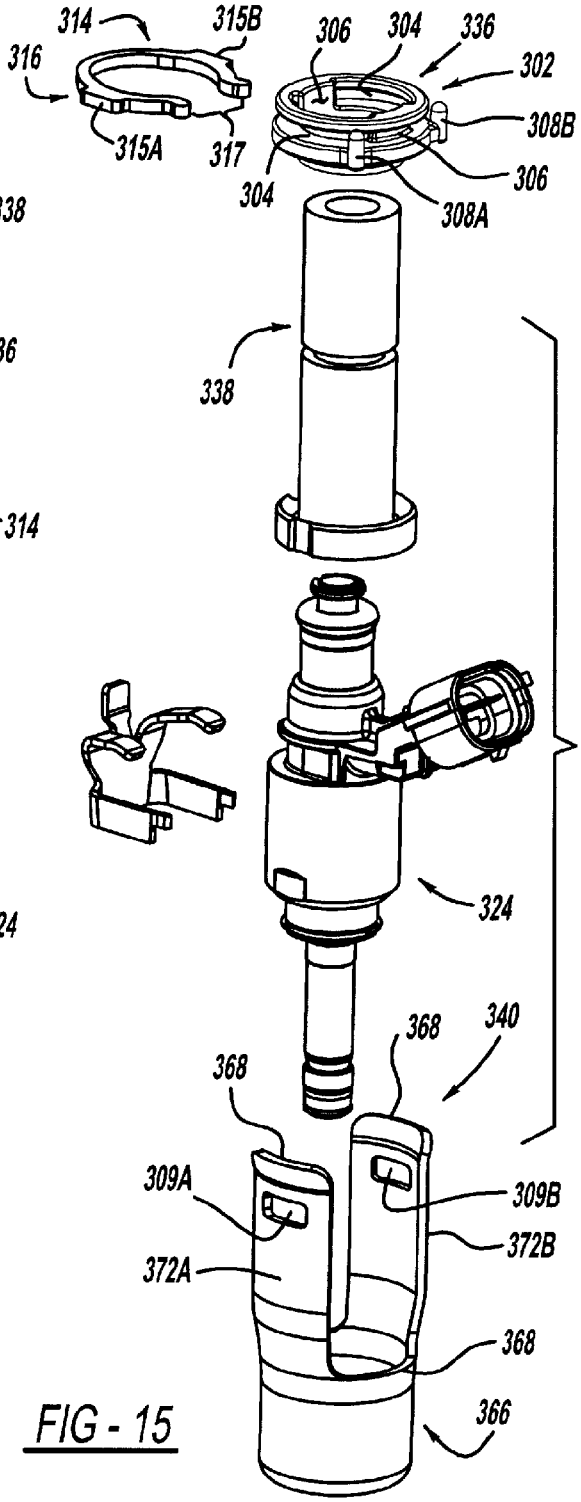
FIG. 15 is a exploded view of the fuel injector cradle mount assembly of FIG. 14.
Figure 16:
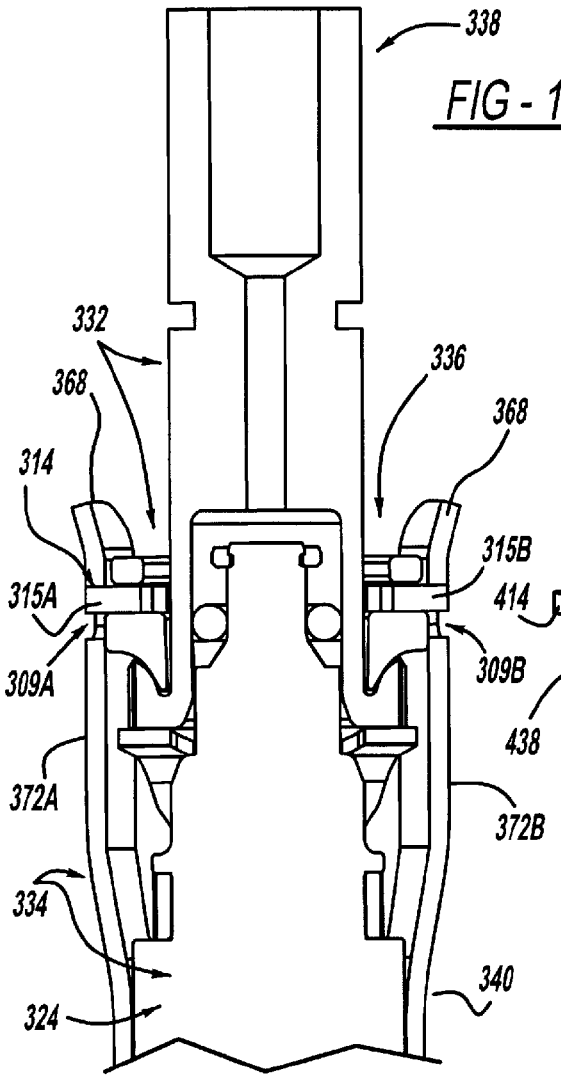
FIG. 16 is a partial cross-sectional view of the fuel injector cradle mount assembly of FIG. 14 taken along line 16-16.

With reference now to FIGS. 14, 15, and 16 a fuel injector 324 may be mounted in a fuel injector cradle mount assembly 300 in accordance with the present disclosure. Fuel injector cradle mount assembly 300, like fuel injector cradle mount assembly 30, may include a connective inlet assembly 332 and an injector cradle assembly 334. Connective inlet assembly 332 may include an alignment ring 336 and a fuel cup 338. Injector cradle assembly 334 may include a cradle 340 and fuel injector 324. Fuel injector cradle mount assembly 300 may be very similar to fuel injector cradle mount assembly 30, including that described further. Alignment ring 336 may include an outer surface 302, which may define a groove 304 around a wall 306. Outer surface 302 may extend or protrude outwards to form a stopper 308A and stopper 308B, which may be referred to as stopper 308A, 308B. Cradle 340 may include a first panel 372A and a second panel 372B, which may be referred to as panel 372A, 372B. Panel 372A, 372B may extend from a top edge 368 on opposite sides of a body 366. Panel 372A may define a hole 309A and panel 372B may define a hole 309B, which may be referred to as hole 309A, 309B. Connective inlet assembly 332 and injector cradle assembly 334 may be coupled with a c-ring 314. C-ring 314 may include a tab 315A and a tab 315B, which may be referred to as tab 315A, 315B, that may extend or protrude from an outer perimeter 316. C-ring 314 may define an opening 317. Panel 372A, 372B of cradle 340 may be aligned to stopper 308A, 308B of alignment ring 336. Using a tool, which is not shown, opening 317 of c-ring 314 may be contracted to position c-ring 314 into groove 304, and extends past stopper 308A, 308B. Wall 306 may secure the horizontal position of c-ring 314. Tab 315A, 315B may extend into hole 309A, 309B, respectively. C-ring 314 may provide a clasping force onto connective inlet assembly 332 and an outwardly press force against the injector cradle assembly 334 to securely couple connective inlet assembly 332 and injector cradle assembly 334.

Figure 17:
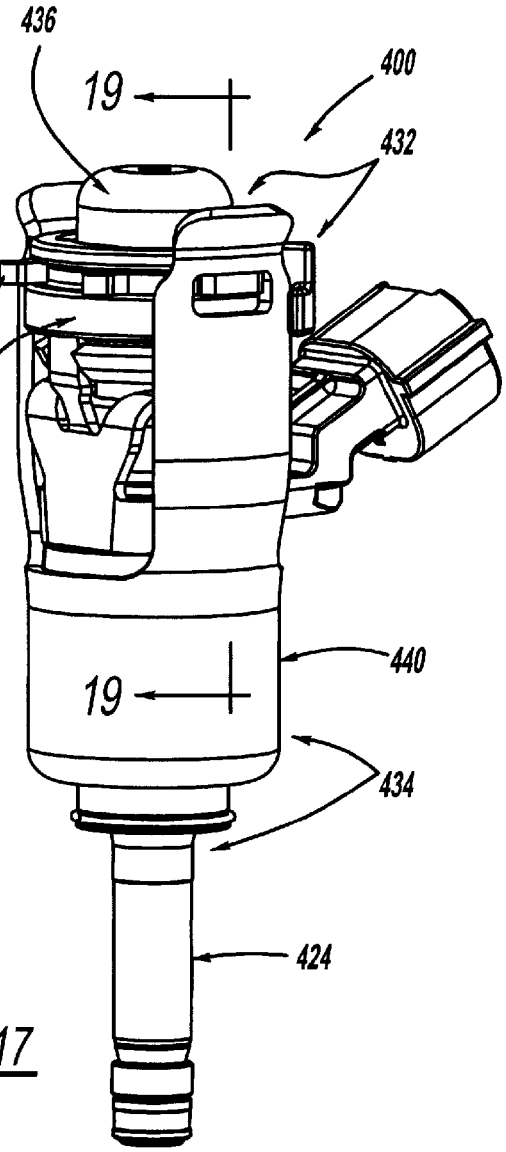
FIG. 17 is a side view depicting a fuel injector in a fuel injector cradle mount assembly in accordance with the present disclosure.
Figure 18:
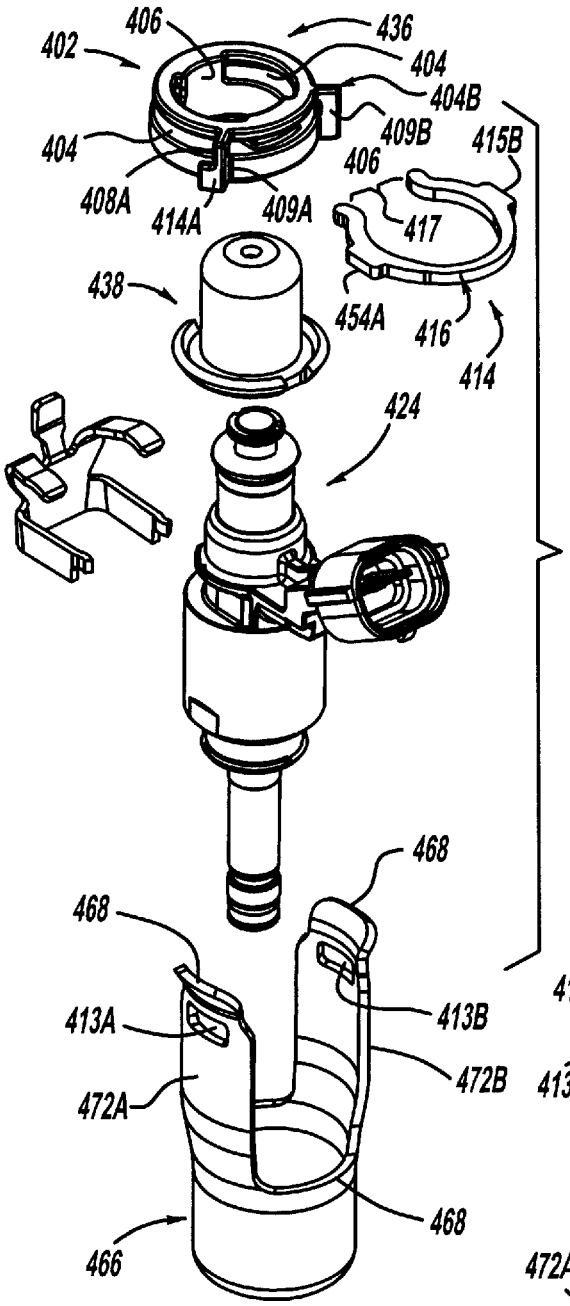
FIG. 18 is a exploded view of the fuel injector cradle mount assembly of FIG. 17.
Figure 19:
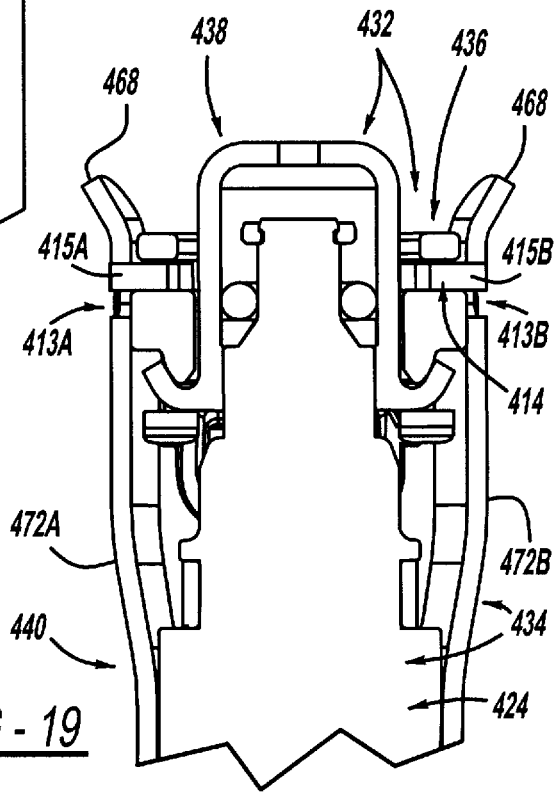
FIG. 19 is a partial cross-sectional view of the fuel injector cradle mount assembly of FIG. 17 taken along line 19-19.

With reference now to FIGS. 17, 18, and 19 a fuel injector 424 may be mounted in a fuel injector cradle mount assembly 400 in accordance with the present disclosure. Fuel injector cradle mount assembly 400, like fuel injector cradle mount assembly 30, may include a connective inlet assembly 432 and an injector cradle assembly 434. Connective inlet assembly 432 may include an alignment ring 436 and a fuel cup 438. Injector cradle assembly 434 may include a cradle 440 and fuel injector 424. Fuel injector cradle mount assembly 400 may be very similar to fuel injector cradle mount assembly 30, including that described further. Alignment ring 436 may include an outer surface 402, which may define a groove 404 around a wall 406. Outer-surface 402 may protrude outward to form a stopper 408A and a stopper 408B, which may be referred to as stopper 408A, 408B. Stopper 408A may include a first surface 409A and a second surface 411A, where second surface 411A may extend perpendicularly from first surface 409A. Stopper 408B may include a first surface 409B and a second surface 411B (not shown but may be identical to second surface 411A), where second surface 411B may extend perpendicularly from first surface 409B. Cradle 440 may include a first panel 472A and a second panel 472B, which may be referred to as panel 472A, 472B. Panel 472A, 472B may extend from a top edge 468 on opposite sides of a body 466. Panel 472A may define a hole 413A and panel 472B may define a hole 413B, which may be referred to as hole 413A, 413B. Connective inlet assembly 432 and injector cradle assembly 434 may be coupled with a c-ring 414. C-ring 414 may include a tab 415A and a tab 415B, which may be referred to as tab 415A, 415B, that may extend or protrude from an outer perimeter 416. C-ring 414 may define an opening 417. Panel 472A, 472B of cradle 440 may be aligned to stopper 408A, 408B of alignment ring 436. Using a tool, which is not shown, opening 417 of c-ring 414 may be contracted to position into groove 404, and pass stopper 408A, 408B. Wall 406 may secure the horizontal position of c-ring 414. Tab 415A, 415B may extend into hole 413A, 413B, respectively. C-ring 414 may provide a clasping force onto connective inlet assembly 432 and an outwardly press force against the injector cradle assembly 434 to securely couple connective inlet assembly 432 and injector cradle assembly 434.

Figure 20:
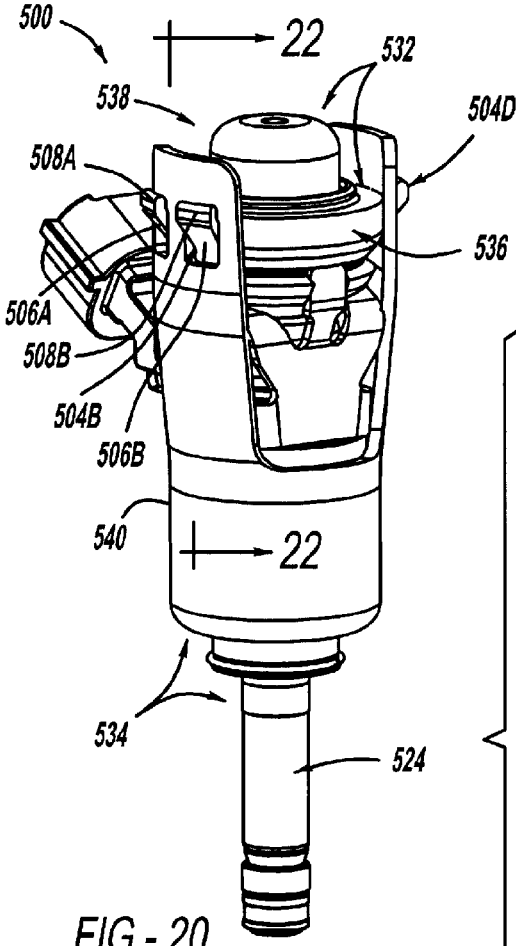
FIG. 20 is a side view depicting a fuel injector in a fuel injector cradle mount assembly in accordance with the present disclosure.
Figure 21:
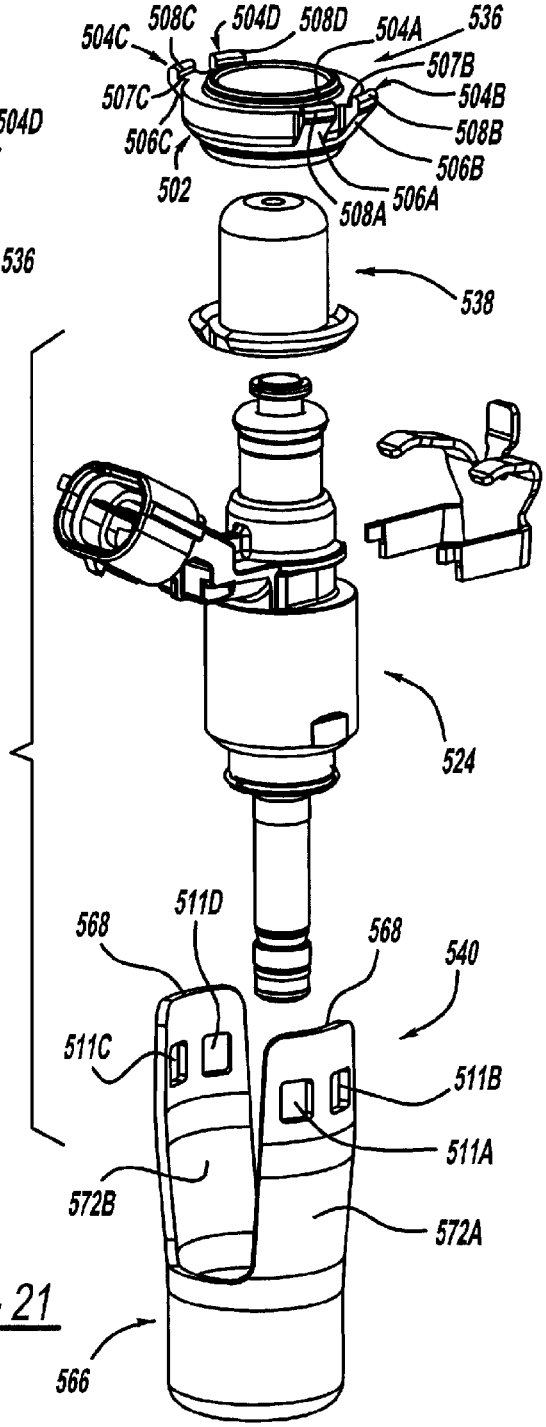
FIG. 21 is a exploded view of the fuel injector cradle mount assembly of FIG. 20.
Figure 22:
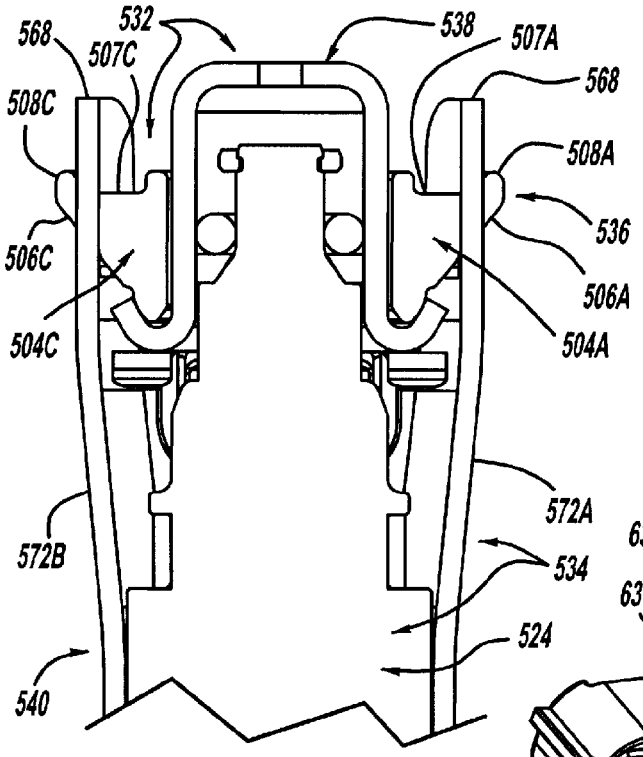
FIG. 22 is a partial cross-sectional view of the fuel injector cradle mount assembly of FIG. 20 taken along line 22-22.

With reference now to FIGS. 20, 21, and 22 a fuel injector 524 may be mounted in a fuel injector cradle mount assembly 500 in accordance with the present disclosure. Fuel injector cradle mount assembly 500, like fuel injector cradle mount assembly 30, may include a connective inlet assembly 532 and an injector cradle assembly 534. Connective inlet assembly 532 may include an alignment ring 536 and a fuel cup 538. Injector cradle assembly 534 may include a cradle 540 and fuel injector 524. Fuel injector cradle mount assembly 500 may be very similar to fuel injector cradle mount assembly 30, including that described further. Alignment ring 536 may include an outer surface 502 that may include a shelf 504A and a shelf 504B, on one side, and a shelf 504C and a shelf 504D, on the opposite side. Shelf 504A, shelf 504B, shelf 504C, and shelf 504D may be referred to as shelf 504A, 504B and shelf 504C, 504D or shelf 504A, 504B, 504C, 504D or any combination thereof. Shelf 504A, 504B, 504C, 504D may include an angular surface 506A, 506B, 506C, 506D, respectively, and a top surface 507A, 507B, 507C, 507D, respectively (angular surface 506D not shown but may be similar to angular surface 506A, 506B, 506C; top surface 507D not shown, but may be similar to top surface 507A, 507B and 507C). Top surface 507A, 507B, 507C, 507D and angular surface 506A, 506B, 506C, 506D may join to form a ridge 508A, 508B, 508C, 508D, respectively, which may protrude slightly upward from top surface 507A, 507B, 507C, 507D. Cradle 540 may include a first panel 572A and a second panel 572B, which may be referred to as panel 572A, 572B. Panel 572A, 572B may extend from a top edge 568 on opposite sides of a body 566. Panel 572A may define a hole 511A and a hole 511B and panel 572B may define a hole 511C and a hole 511D, which may be referred to as hole 511A, 511B and hole 511C, 511D or hole 511A, 511B, 511C, 511D or any combination thereof. Connective inlet assembly 532 and injector cradle assembly 534 may be secured by aligning hole 511A, 511B, 511C, 511D with shelf 504A, 504B, 504C, 504D, respectively. Panel 572A, 572B may be secured by positioning hole 511A, 511B, 511C, 511D over ridge 508A, 508B, 508C, 508D, respectively, and having panel 572A, 572B resting on top surface 507A, 507B and top surface 507C, 507D, respectively. Ridge 508A, 508B, 508C, 508D may prevent horizontal movement of panel 572A, 572B, and may securely couple connective inlet assembly 532 and injector cradle assembly 534.

Figure 23:
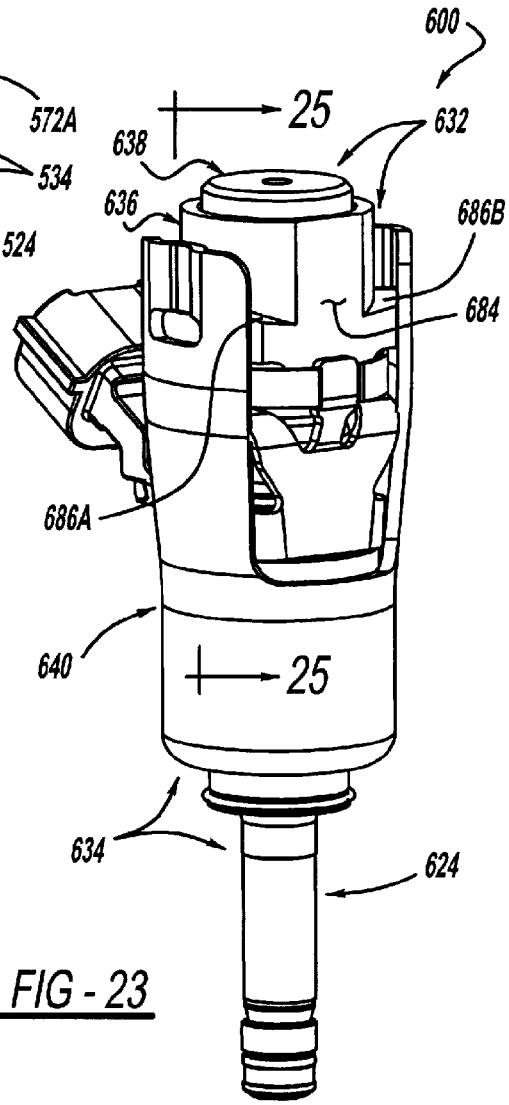
FIG. 23 is a side view depicting a fuel injector in a fuel injector cradle mount assembly in accordance with the present disclosure.
Figure 24:
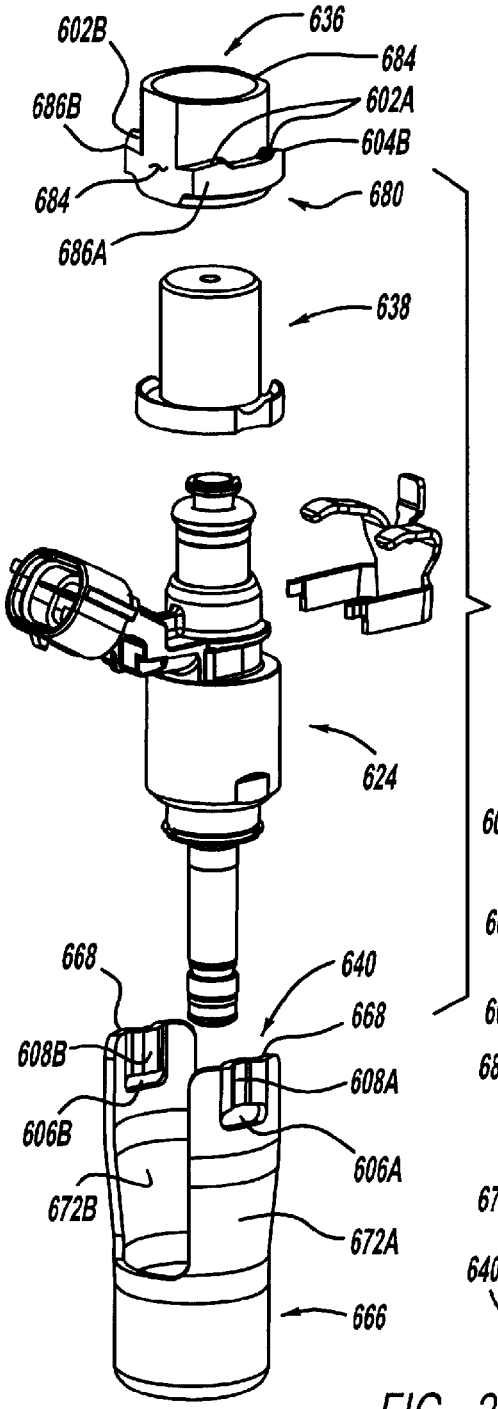
FIG. 24 is a exploded view of the fuel injector cradle mount assembly of FIG. 23.
Figure 25:
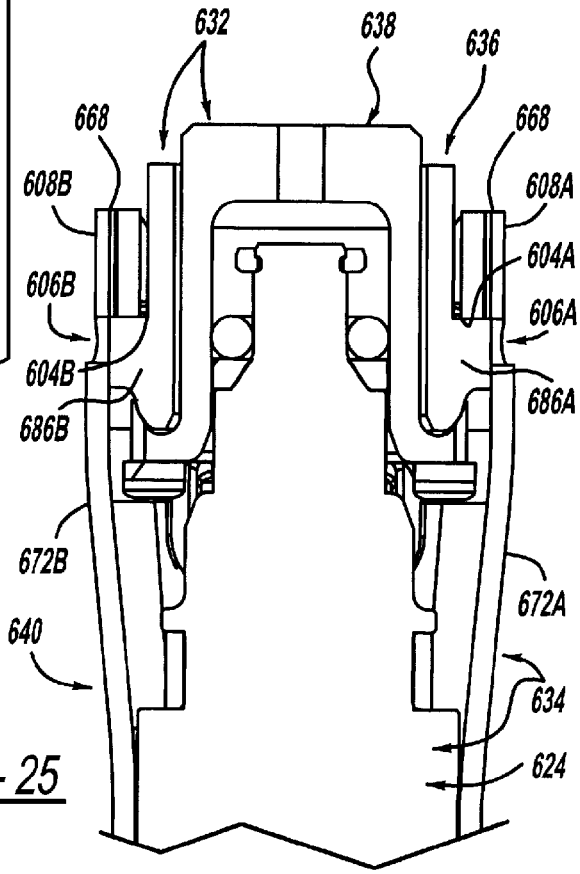
FIG. 25 is a partial cross-sectional view of the fuel injector cradle mount assembly of FIG. 23 taken along line 25-25.
Figure 26:
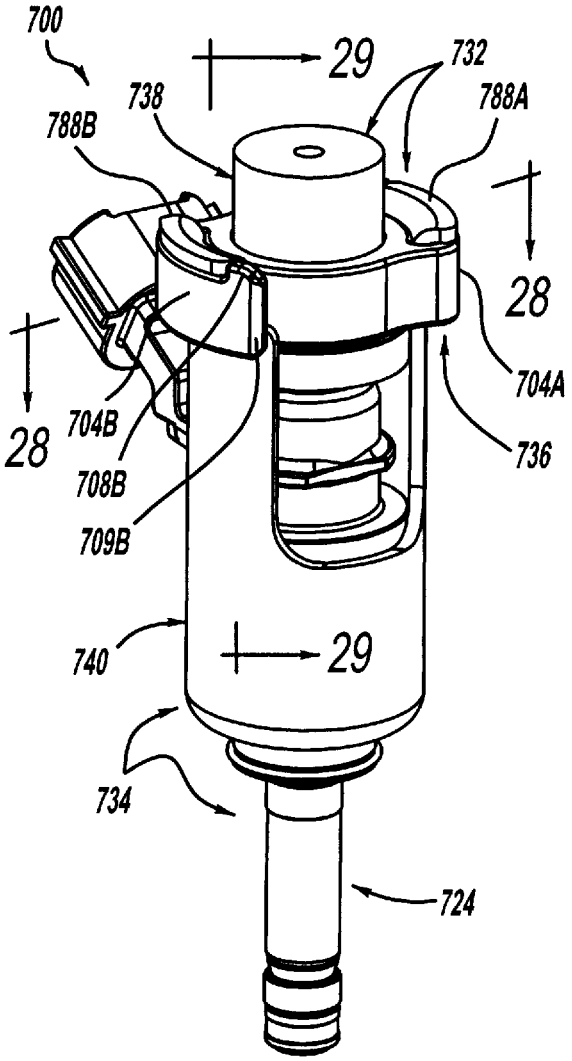
FIG. 26 is a side view depicting a fuel injector in a fuel injector cradle mount assembly in accordance with the present disclosure.
Figure 27:
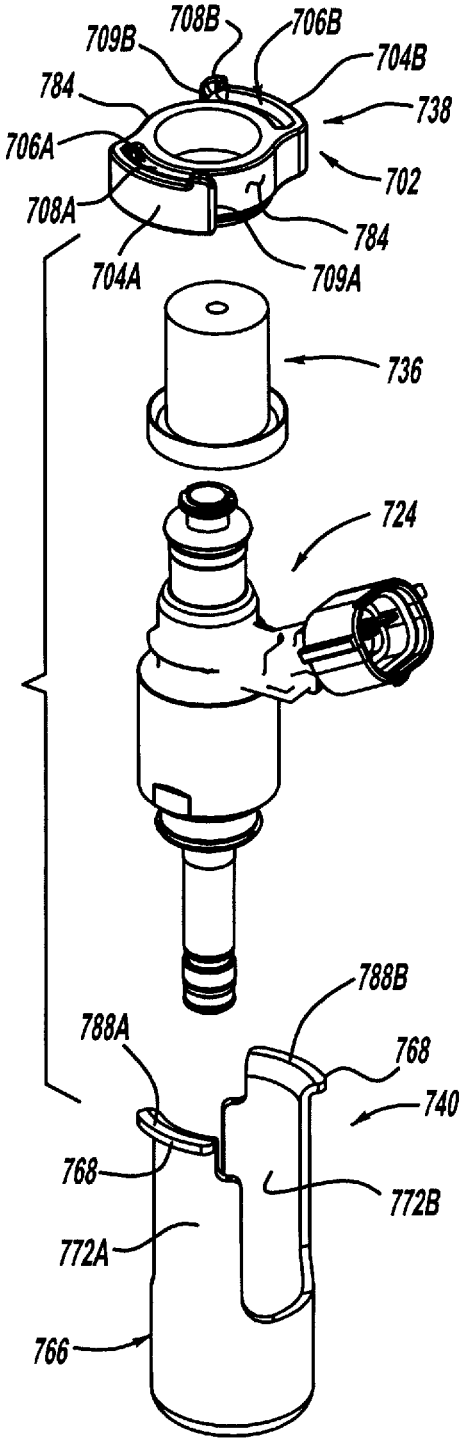
FIG. 27 is a exploded view of the fuel injector cradle mount assembly of FIG. 26.
Figure 28:
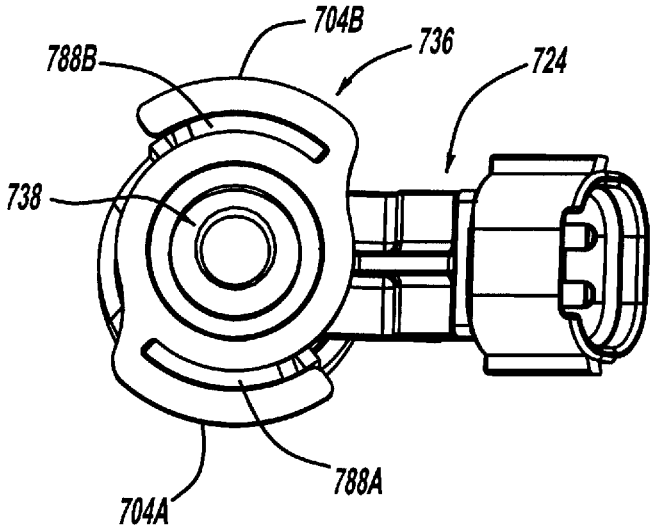
FIG. 28 is a top view of the fuel injector cradle mount assembly of FIG. 26 taken along line 28-28.
Figure 29:
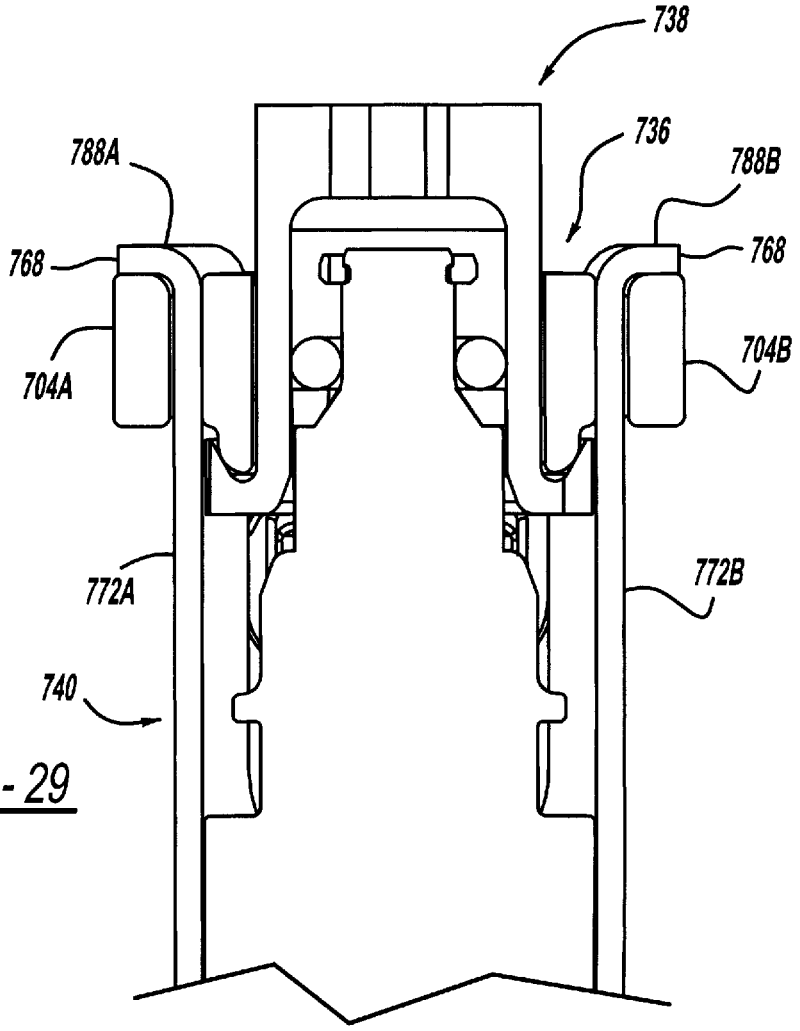
FIG. 29 is a partial cross-sectional view of the fuel injector cradle mount assembly of FIG. 26 taken along line 29-29.

With reference now to FIGS. 23, 24, and 25 a fuel injector 624 may be mounted in a fuel injector cradle mount assembly 600 in accordance with the present disclosure. Fuel injector cradle mount assembly 600, like fuel injector cradle mount assembly 30, may include a connective inlet assembly 632 and an injector cradle assembly 634. Connective inlet assembly 632 may include an alignment ring 636 and a fuel cup 638. Injector cradle assembly 634 may include a cradle 640 and fuel injector 624. Fuel injector cradle mount assembly 600 may be very similar to fuel injector cradle mount assembly 30, including that described further. Alignment ring 636 may include a bottom perimeter 680. Bottom perimeter 680 may include a first bottom ledge 686A and a second bottom ledge 686B, which may be referred to as ledge 686A, 686B. Ledge 686A, 686B may extend or protrude from opposite sides of bottom perimeter 680 with a flush surface 684 located therebetween. Ledge 686A may include a first surface 602A and a second surface 604A, where second surface 604A may be between and below first surface 602A. Ledge 686B may include a first surface 602B and a second surface 604B, where second surface 604B may be between and below first surface 602B (second surface 604B not shown, but may be similar to second surface 604A). Cradle 640 may include a first panel 672A and a second panel 672B, which may be referred to as panel 672A, 672B. Panel 672A, 672B may extend from a top edge 668 on opposite sides of a body 666. Panel 672A may define a hole 606A and panel 672B may define a hole 606B, which may be referred to as hole 606A, 606B. Above hole 606A, 606B the panel 672A, 672B may indent inward to form a crimp 608A, 608B, respectively. Connective inlet assembly 632 and injector cradle assembly 634 may be secured by aligning panel 672A, 672B along flush surface 684 of alignment ring 636. Alignment ring 636 may be rotated to align second surface 604A, 604B below crimp 608A, 608B, respectively. Crimp 608A, 608B may exert a clasping force onto second surface 604A, 604B and first surface 602A, 602B to securely couple connective inlet assembly 632 and injector cradle assembly 634.

With reference now to FIGS. 26, 27, 28, and 29 a fuel injector 724 may be mounted in a fuel injector cradle mount assembly 700 in accordance with the present disclosure. Fuel injector cradle mount assembly 700, like fuel injector cradle mount assembly 30, may include a connective inlet assembly 732 and an injector cradle assembly 734. Connective inlet assembly 732 may include an alignment ring 736 and a fuel cup 738. Injector cradle assembly 734 may include a cradle 740 and fuel injector 724. Fuel injector cradle mount assembly 700 may be very similar to fuel injector cradle mount assembly 30, including that described further. Alignment ring 736 may include an outer surface 702, an arm 704A and an arm 704B, where arm 704A and arm 704B may extend from and on opposite sides of outer surface 702 with a flush surface 784 therebetween. Arm 704A and arm 704B may be referred to as arm 704A, 704B. Arm 704A, 704B may define an opening 706A, 706B, respectively, between outer surface 702. Arm 704A, 704B may include a ridge 708A, 708B, respectively, that extends or protrudes from an end 709A, 709B of arm 704A, 704B, respectively. Cradle 740 may include a first panel 772A and a second panel 772B, which may be referred to as panel 772A, 772B. Panel 772A, 772B may extend from a top edge 768 on opposite sides of a body 766. Top edge 768 of panel 772A, 772B may outwardly protrude away to form a crown 788A, 788B, respectively, which may be perpendicular to a central vertical axis of cradle 740. Connective inlet assembly 732 and injector cradle assembly 734 may be secured by aligning panel 772A, 772B along flush surface 784 of alignment ring 736. Alignment ring 736 may be rotated to position panel 772A, 772B into opening 706A, 706B, respectively, to lock or couple connective inlet assembly 732 to injector cradle assembly 734. Crown 788A, 788B may be positioned over arm 704A, 704B, respectively. Ridge 708A, 708B may prevent cradle 240 from rotating by retaining panel 772A, 772B in opening 706A, 706B respectively.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

What is claimed is:

1. A fuel injector cradle mount assembly for a vehicle having an engine, the fuel injector cradle mount assembly comprising:

a fuel injector rail;

a connective inlet assembly coupled to the fuel injector rail, the connective inlet assembly including a fuel cup and an alignment ring separate from the fuel cup, wherein the fuel cup includes a collar that defines an indentation, the collar radially extends from one end of the fuel cup that is opposite to the other end of the fuel cup that is coupled to the fuel injector rail, and the alignment ring is disposed around the fuel cup and directly abuts with the collar of the fuel cup;

a fuel injector includes a torso and a nozzle, the torso having a first end and a second end, wherein the torso includes a base portion on the first end, and the torso defines an inlet on the second end opposite the first end;

a cradle having a top end and a bottom end, wherein the top end extends to the connective inlet assembly to form a panel, the bottom end bends to form a shoulder having an "L" shaped cross-section; and a clip including a neck disposed at the indentation of the fuel cup, wherein the fuel injector is arranged and secured between the connective inlet assembly and the cradle, the inlet of the fuel injector is coupled to the connective assembly, the base portion of the fuel injector rests on the shoulder, the panel is coupled to the alignment ring of the connective inlet assembly, and the fuel injector is supported by the cradle and the fuel injector rail, the alignment ring of the connective inlet assembly is positioned between the cradle and the fuel cup such that the alignment ring isolates the cradle from the fuel cup;

the panel is directly coupled to the connective inlet assembly;

the fuel cup has a column, one end of the column is coupled to the fuel injector rail and the other end has the collar that is integral with the column, and the collar defines a cavity, and the alignment ring has a rim, an upper perimeter, a bottom perimeter below the upper perimeter, and a flush surface, the rim is located at a bottom portion of the alignment ring, the flush surface extends from the upper perimeter to the bottom perimeter along a portion of the alignment ring, the upper perimeter has an upper ledge on either side of the flush surface, the bottom perimeter has a bottom ledge below the upper ledge on either side of the flush surface, the upper ledge and the bottom ledge extend radially outwards from the upper perimeter and the bottom perimeter, respectively, and the upper ledge and the bottom ledge define a retention groove on either side of the flush surface, and the alignment ring sits around the column, the rim is disposed in the cavity of the fuel cup, and the bottom portion of the alignment ring rests on the collar.

2. The mount assembly of claim 1, wherein the nozzle of the fuel injector further includes:

a third end that is received by the engine;

a fourth end that is opposite the third end, the fourth end abuts the base of the torso; and wherein the engine receives the nozzle first and the base second.

3. The mount of assembly of claim 2, wherein the fuel injector is axially supported at the base by the cradle and the fuel injector rail, and is radially aligned by the engine.

4. The mount assembly of claim 1, wherein the top end of the panel is bent away from the connective inlet assembly to form a crown that is aligned to the upper ledge.

5. The mount assembly of claim 4, wherein the panel is coupled to the connective inlet assembly with a retention ring, the retention ring is positioned in the retention groove, and the retention ring is below the upper ledge and the crown, and above the bottom ledge.

6. A fuel injector cradle mount assembly for a vehicle having an engine, the fuel injector cradle mount assembly comprising:

a fuel injector rail;

a connective inlet assembly coupled to the fuel injector rail, the connective inlet assembly including a fuel cup and an alignment ring separate from the fuel cup, wherein the fuel cup includes a collar that defines an indentation, and the alignment ring is disposed around the fuel cup and directly abuts with the collar of the fuel cup;

a fuel injector includes a torso and a nozzle, the nozzle having a first end and a second end, wherein the first end extends from a base portion of the torso;

a cradle includes a body, a shoulder, and a panel, the body defining an opening to receive the fuel injector, the shoulder extending from a bottom end of the body towards the opening having an "L" shaped cross section, the panel extends from a top end of the body on opposite sides of the opening; and a clip including a neck, wherein the fuel injector is arranged and secured between the connective inlet assembly and the cradle, the fuel injector is received in the opening, the base rests on the shoulder, the panel is coupled to the connective inlet assembly, and the fuel injector is supported by the cradle to the fuel injector rail over the engine, the clip is disposed on the fuel injector on a side that is opposite of an electric connector attached to the fuel injector, and the neck of the clip is disposed in the indentation of the connective inlet assembly;

the panel is directly coupled to the connective inlet assembly;

the fuel cup has a column, one end of the column is coupled to the fuel injector rail and the other end has the collar that is integral with the column, the collar defines a cavity;

the alignment ring has a rim, an upper perimeter, a bottom perimeter below the upper perimeter, and a flush surface, the rim is located at a bottom portion of the alignment ring and is disposed in the cavity, and the bottom portion of the alignment ring rest on the collar, the flush surface extends from the upper perimeter to the bottom perimeter along a portion of the alignment ring, the upper perimeter has an upper ledge on either side of the flush surface, the bottom perimeter has a bottom ledge below the upper ledge on either side of the flush surface, the upper ledge and the bottom ledge define a retention groove on either side of the flush surface, the upper ledge and the bottom ledge extend radially outwards from the upper perimeter and the bottom perimeter, respectively, and the alignment ring is coupled to the cradle.

7. The mount assembly of claim 6, wherein the top end of the panel is bent away from the connective inlet assembly to form a crown that is aligned to the upper ledge.

8. The mount assembly of claim 7, wherein the panel is coupled to the connective inlet assembly with a retention ring, the retention ring is positioned into the retention groove, the retention ring is below the upper ledge and the crown, and above the bottom ledge.

* * * * *